US012239210B2

(12) United States Patent
Fogueteiro

(10) Patent No.: US 12,239,210 B2
(45) Date of Patent: Mar. 4, 2025

(54) COSMETIC PRODUCT APPLICATION TIP INCLUDING BEADS SPIRALLING OVER AN AXISYMMETRIC MAIN BODY

(71) Applicant: CHANEL PARFUMS BEAUTE, Neuilly-sur-Seine (FR)

(72) Inventor: Paulo Fogueteiro, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 18/379,982

(22) Filed: Oct. 13, 2023

(65) Prior Publication Data

US 2024/0122333 A1 Apr. 18, 2024

(30) Foreign Application Priority Data

Oct. 14, 2022 (EP) ..... 22306559

(51) Int. Cl.
*B43M 11/02* (2006.01)
*A45D 40/26* (2006.01)

(52) U.S. Cl.
CPC ..... *A45D 40/265* (2013.01); *A45D 40/261* (2013.01); *A45D 40/262* (2013.01); *A45D 2200/10* (2013.01); *A46B 2200/1046* (2013.01); *A46B 2200/1053* (2013.01)

(58) Field of Classification Search
CPC .. A45D 40/261; A45D 40/262; A45D 40/265; A46B 2200/1046; A46B 2200/1053
USPC ..... 401/126, 128–130, 218
See application file for complete search history.

(56) References Cited

U.S. PATENT DOCUMENTS

| | | | | |
|---|---|---|---|---|
| 11,412,832 | B2 * | 8/2022 | Bose | A45D 34/046 |
| 11,457,718 | B2 * | 10/2022 | Garrison | A45D 34/046 |
| 12,011,078 | B2 * | 6/2024 | Kingswell | A45D 34/04 |
| 2017/0020266 | A1 | 1/2017 | Sanchez | |
| 2021/0059392 | A1 | 3/2021 | Schreiber et al. | |
| 2024/0180320 | A1 * | 6/2024 | Von Jan | A46B 9/025 |

FOREIGN PATENT DOCUMENTS

| | | | |
|---|---|---|---|
| FR | 3 013 197 | A1 | 5/2015 |
| FR | 3 013 951 | A1 | 6/2015 |
| FR | 3 014 656 | A1 | 6/2015 |
| FR | 3 023 458 | A1 | 1/2016 |
| FR | 3 070 840 | A1 | 3/2019 |
| WO | 2016/202929 | A1 | 12/2016 |

OTHER PUBLICATIONS

European Search Report issued in European (EPO) Patent Application No. 22306559.0, dated Feb. 23, 2023.
Note—FR3013197 is discussed in paragraph 0013 of the specification of the instant application.

* cited by examiner

*Primary Examiner* — Jennifer C Chiang
(74) *Attorney, Agent, or Firm* — GREENBLUM & BERNSTEIN, P.L.C.

(57) ABSTRACT

A cosmetic-product application tip including a main body having an axisymmetric general shape around a main axis defining a longitudinal direction. In the application tip, beads are formed at the surface of said main body from which each of the beads projects extending while spiralling around the main axis. In addition to the foregoing, an applicator includes such a tip and a set including such an applicator and a bottle.

18 Claims, 3 Drawing Sheets

COSMETIC PRODUCT APPLICATION TIP INCLUDING BEADS SPIRALLING OVER AN AXISYMMETRIC MAIN BODY

CROSS-REFERENCE TO RELATED APPLICATION

The present application claims priority under 35 U.S.C. § 119 of European Patent Application No. EP 22306559.0, filed Oct. 14, 2022, the disclosure of which is expressly incorporated by reference herein in its entirety.

The present invention relates to the field of cosmetic product applicators.

In particular, it relates to an application tip adapted for the application of a liquid, viscous or pasty cosmetic product on the skin, for example over the contour of the eyes, in particular under the eyes. In general, in the present document, the application of a cosmetic product on the skin is considered, yet without limiting the invention to this application area.

In the present document, an application tip refers to the portion of an applicator intended to be brought into contact with the skin to apply the cosmetic product.

In the present document cosmetic products encompass in particular all products for making up the skin, lips or keratinous appendages. The applicator that is the object of the present invention is also adapted to applying care products, in particular liquid and viscous care formulae, intended for applying to the skin, lips or the keratinous appendages. For simplicity, in the whole of the present document, when reference is made to a cosmetic product, this also includes care products.

In the remainder of the present document, the term "user" obviously designates a user of either sex.

Cosmetic products must be deposited on the skin homogeneously, in a fine even layer. Ideally, the applicator must also allow a light massage of the area of application of the cosmetic product. A sensation of coolness during application may also be sought.

Various applicators have been envisaged for this.

The most frequent applicators that are adapted to apply cosmetic products are thus applicators of the "pressed tube" type, applicators of the "stick with applicator tip" type, and rotary-ball applicators, often designated by the English expression "roll-on".

Applicators of the "pressed tube" type include a flexible tube containing the product to be applied. The tube must be pressed to cause the product to emerge, via an orifice located on a relatively flat and generally metallic area, in order to provide a sensation of coolness during application. The quantity of product delivered with this type of applicator is imprecise since it depends on the force applied to the tube. Furthermore, spreading the product by means of the applicator surface is done by rubbing on the skin, which does not make it possible to deposit an even film of product. Rubbing during application may also be rough or even irritating for the skin.

Applicators of the "stick with applicator tip" type include a metal stick with a rounded tip. They stick and its tip must be immersed in the cosmetic product for the tip to be covered with the product. The product is applied by rubbing the tip on the skin of the user, or by depositing spots of product by repeated contacts of the applicator on the skin. Just like an applicator of the pressed-tube type, this does not allow even application of the product. Rubbing during application may also be rough or even irritating for the skin.

Furthermore, product tends to be lodged between the stick and the tip and forms a mass that is not applied.

Finally, "roll-on" applicators generally include a flexible tube and a tip with a rotatably mounted ball that is loaded with product on its surface internal to the tip when the tube is pressed. The surface of the ball loaded with product is next turned towards the outside of the tip, rolling on the skin of the user, to enable the product to be applied. This type of applicator does not allow precise apportioning of the product applied, the tube having to be pressed to load the ball. The quality of the application depends on the orientation of the applicator, the tip having to be oriented downwards to allow good application.

In fine, applicators whose surface is smooth, whether they are used by rubbing or by rolling on the skin do not enable an accurate dosage of the applied amount of product.

The document FR3013197 discloses an applicator whose tip has an axisymmetric shape which is smooth or provided with longitudinal striations (parallel to the main axis of the applicator). When the product is applied, the applicator can be moved in contact with the skin by making it slide over it with optionally a rotation movement of the application member on itself about an axis parallel to the longitudinal axis of the stick and/or perpendicular to the longitudinal axis. With such an applicator, the gesture necessary to obtain a proper result is not simple, and the application of the product could be irregular. Furthermore, the dosage of the amount of product applied is barely accurate, and the longitudinal striations are incompatible with passage in a squeegee device (explained hereinafter), which would pull of all of the product present over the applicator.

The present invention aims to provide a tip for applying a cosmetic product, including liquid, viscous or pasty care products, enabling an even and continuous application of an accurate dose of product over an application area having a defined surface, while enabling a massage of the entire application area. Such an application must preferentially be achievable in a simple and ergonomic manner, with an action that is obvious for the user.

To this end, the invention covers a cosmetic product application tip including a main body having an axisymmetric general shape around a main axis defining a longitudinal direction. Beads are formed at the surface of said main body from which they project, each of said beads extending while spiralling, around the main axis.

The presence of beads that spiral at the surface of a main body having an axisymmetric shape, offers several effects and advantages. On the one hand, this forms between the beads spaces adapted for retaining the cosmetic product, for example with an accurate, calibrated volume, corresponding to a desired dose of the cosmetic product. The configuration, in particular the height of the beads with respect to the surface of the main body and their width, could allow modulating these spaces, and therefore calibrating the product dose retained by the application tip. The fact that the beads form turns allows accompanying, naturally guiding, the movement of the user during the application of the cosmetic product. The concepts of "spiral" and "to spiral" refer to the fact that the beads formed at the surface of the main body of the applicator turn around the longitudinal main axis while progressing longitudinally. Hence, the spiral formed by the beads may, in particular, be a helix, or a series of helix portions, whose pitch and/or radius are set or variable. In practice, a bead forms a turn or a turn portion.

More specifically, the spiralling configuration of each bead causes the bead to bear on the skin each time a rotational movement is imparted to the application tip during the application of the cosmetic product. The beads enable some adhesion of the application tip on the skin, and their configuration enables this adhesion to be even, regardless of the angular position of the applicator upon contact thereof with the skin. There is no jerking caused by the beads upon rotation of the application tip around its main axis, whereas it is in contact with the skin. Nevertheless, thanks to the spiral-like beads, rolling of the application tip over the sin could result in alternate pressure on the skin (like "wavelets") promoting a blood micro-circulation in the application area. The effect is thus similar to that of a tapping action that is recommended when applying a cosmetic product to the eye area. In particular, it is possible to configure the beads so that substantially the same surface area of the bead is in contact with the skin throughout an application of the cosmetic product. Finally, when the application tip is used in a set including a squeegee, the fact that the beads are not longitudinal allows avoiding the squeegee pulling all or almost all of the product off the tip upon passage thereof in the squeegee.

Advantageously, there is a space between two furrows, i.e. two adjacent furrows are not in contact with each other along the main body. A furrow may be formed over the main body in each space between two beads. The furrow allows increasing the product loading volume of the applicator. The furrow may cover all or part of the width of the space formed between two beads.

In particular, the main body may be metallic, made of ceramic, or of wood. A metal application tip offers a sensation of coolness to the user during application. A decongestioning effect on the skin can also be obtained. This also confers on the application tip an aesthetically-pleasant appearance. A metal or ceramic tip is generally perceived as an object of great quality by the user. A tip made of wood, or another natural material, is perceived as a simple element and may be formed in an environmentally-friendly manner.

The main body may be made of a plastic material. The use of plastic facilitates the manufacture and limits the cost of the application tip. The application tip may receive a metallic coating, for example by vapour phase deposition, to confer a metallic appearance and touch thereon.

The beads may be formed integrally in one-piece with the main body. Advantageously, the beads are devoid of spikes or other projecting protuberances. The same applies to the rest of the application tip.

The beads may be formed of an elastomeric material. Beads formed of an elastomeric material offer a soft feel upon application of the cosmetic product. In comparison with smooth metal or plastic, adhesion on the skin is better, which improves guidance of the gesture of the user.

Each bead may be configured so that it turns around the main axis over a total angle comprised between 90° and 720°, preferably in the range of 180°.

The beads may have a section whose dimensions are variable along each bead.

Hence, each bead forms between a quarter turn and one turn at the surface of the main body of the application tip.

Throughout the present document, "about" or "in the range of" corresponds to the value indicated more or less 20%.

The rotational angle that each bead forms around the main axis of the application tip confers on the beads an angle with respect to the direction of rolling of the applicator over the skin that is not too large to enable a good adhesion on the skin, while being adapted to property accompany the movement of the applicator, and allowing avoiding an excessive wiping upon passage of the application tip in a squeegee.

The application tip may also have one or more of the following features:

- it may include exactly three, four, five, six, seven, eight, nine or ten beads;
- each bead may have a rounded section, with no sharp edge;
- the beads may have a roughness different from the roughness of the main body;
- the main body may have a so-called bud-like general shape, i.e. an elongate axisymmetric shape flaring progressively and terminating in a rounded tip;
- the main body may have a spherical, axisymmetric cylindrical, or ogive-like shape.

The invention also covers a cosmetic product applicator including an application tip as defined hereinabove, a gripping element, and a longitudinal rigid stick linking the gripping element to the application tip.

The application tip may be rotatably mounted around the main axis relative to the gripping element.

In this case, the rotation of the applicator is done very easily, with a simple gesture of the user who does not have to impart this rotation by himself/herself. The beads ensure rolling without slipping or with a slight slip, over the skin, which is regular, without jerking. They also contribute to the massage effect, rolling of the applicator provided with spiral-like beads, for example helical, causing a slight overpressure whose position evolves longitudinally (relative to the applicator) when the application tip rolls over the skin.

Finally, the invention covers a set including a bottle and an applicator as defined hereinabove, wherein the bottle contains the cosmetic product, the bottle including a neck adapted to be sealed off by the gripping element, so that, when the bottle is sealed off by said gripping element, the application tip is in contact with the cosmetic product.

The bottle may include a squeegee, the squeegee providing wiping of the application tip as it passes, so that a defined quantity of product is carried by the application tip after the applicator is extracted from the bottle.

A squeegee is a device allowing wiping the application tip upon passage thereof, so that a definite amount of product is carried by the application tip, after extraction of the applicator from the bottle. Thanks to their spiralling configuration, the beads, and where appropriate the furrows formed between the beads, allow loading the application tip with an accurate, optimum and regular amount of product, which should be applied over a given area of the user (for example under an eye), and that this amount is actually present on the application tip after passage in the squeegee.

In the appended drawings, given by way of non-limiting examples:

Figure 1:
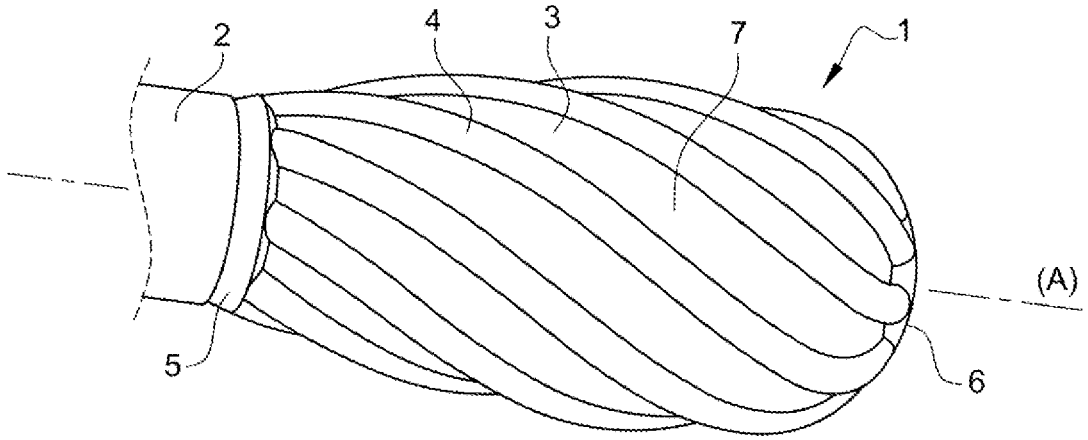
FIG. 1 is a three-dimensional schematic view of a cosmetic product application tip in accordance with an embodiment of the invention.

FIG. 1 shows a cosmetic product application tip 1 in accordance with an embodiment of the invention. This application tip 1 is intended to be joined end-to-end to a stick 2 to form a cosmetic product applicator.

The application tip 1 includes a main body 3. The main body 3 has an axisymmetric shape around a main axis A. Thus, any cross-section of the main body 3, in any plane orthogonal to the main axis A, is circular.

The main axis A defines the longitudinal direction.

The main body 3 is a solid element, which could be formed of various materials. The main body 3 may be metallic, for example made of stainless steel. The main body 3 may be made of ceramic. The main body 3 may be made of plastic material.

The application tip further includes beads 4. The beads 4 are formed at the surface of the main body 3. The beads 4 are elongate elements, which project from the surface of the main body 3. The beads 4 may have various cross-sections. Preferably, they are rounded. In the example that is shown herein, the beads 4 have a substantially semi-circular section.

Each bead 4 extends at the surface of the main body 3 while spiralling around the main axis A. Thus, each bead may, for example, form a helix portion at the surface of the main body 3.

The main body 3 includes a first end 5, intended to be joined end-to-end to the stick 2, and a second end 6, which is a free end.

Each bead 4 extends between the first end 5 and the second end 6. While spiralling, each bead forms between a quarter-turn ad a turn around the main axis, namely between 90° and 360°. In particular, winding over about 180° is possible. Winding over up to two turns (720°) is also possible.

The application tip includes at least two beads 4. Advantageously, it includes between three and ten beads 4. In the shown example, the application tip includes eight beads.

Advantageously, the beads 4 are evenly distributed at the periphery of the main body. One could talk about a distribution according to a radial symmetry. In other words, in any cross-section of the application tip, each bead is at the same distance from two beads that surround it (or are diametrically opposite if there are only two beads).

In the illustrated example, the tip is rounded at its second end 6, and the beads 4 meet together at said second end 6.

The beads 4 may be formed of the same material as the main body 3. For example, they may be formed integrally in one-piece with the main body 3. Alternatively, they may be affixed on the main body.

According to one embodiment, the beads 4 are formed of an elastomeric material. This includes any polymer having elastic properties, in particular organic polymers, such as rubbers, and mineral polymers such as silicones. In particular, the beads 4 may be overmoulded over the main body 3.

The space 7 formed between two successive beads (by successive, it should be understood that no other bead is interposed between the two considered beads, along the surface of the main body 3) forms a volume adapted to receive the cosmetic product and to retain it. The bottom of this space 7, i.e. the surface of the main body 3 between the beads 4, may have a texture, which, by increasing the roughness of the surface, improves the retention of the cosmetic product on the application tip 1.

Figure 2:
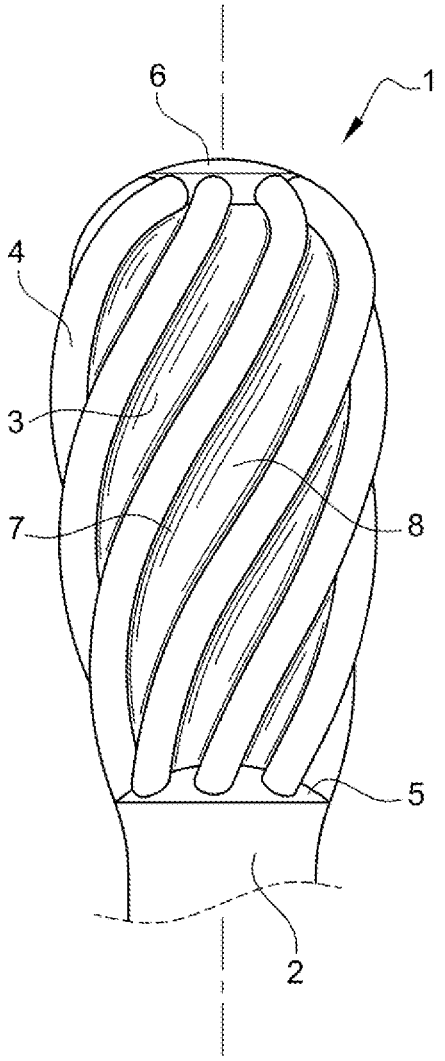
FIG. 2 is another three-dimensional schematic view of an application tip in accordance with an embodiment of the invention.

As illustrated in FIG. 2, to obtain a greater loading, it is possible to form furrows 8 between the beads 4. Except this difference, detailed hereinafter, the application tip of FIG. 2 is identical to that of FIG. 1 and reference may be made to the description of FIG. 1 for the embodiment of FIG. 2.

The furrows 8 are elongate cavities, formed in the main body 3, between two beads 4. More specifically, a furrow 8 is advantageously formed between any pair of successive beads. Each furrow 8 may be formed over the entire width separating two beads 4 (i.e. over the entire width of each space 7), or only over a portion of this width. In this case, several furrows may be formed, where appropriate, between two beads.

Thus, the furrows 8 may have a substantial depth. The furrows 8 do not communicate with each other, so that during the application of the cosmetic product, the dose carried by the application tip is progressively applied. Thus, the cosmetic product dose portion present between two beads is deposited only when the space 7 between the two considered beads is in contact with the skin.

The bottom of the furrows may have a texture promoting retention of the cosmetic product, or, on the contrary, facilitating deposition thereof during application.

In the embodiments of FIG. 1 and of FIG. 2, the main body has a so-called "bud-like" axisymmetric shape. A bud-like shape refers to an elongate axisymmetric shape flaring progressively (from the first end 5 towards the second end 6) and terminating in a rounded tip.

Nevertheless, any axisymmetric shape may be considered to form the main body of an application tip in accordance with the present invention.

Figure 3:
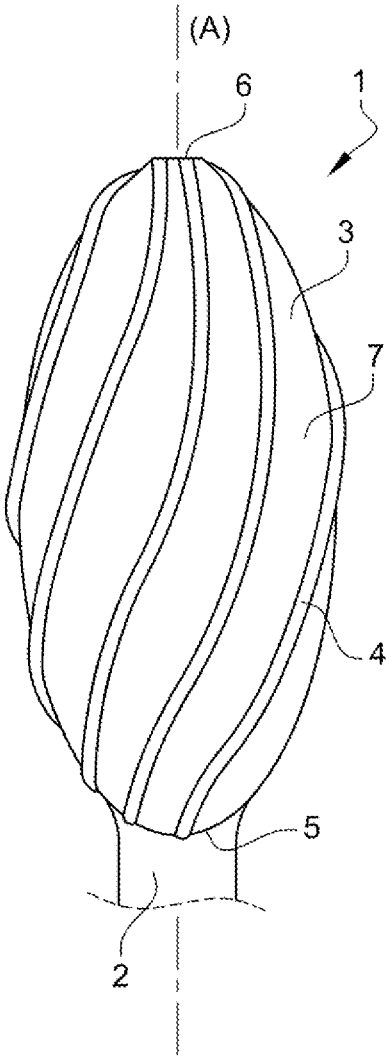
FIG. 3 is a schematic view of an application tip according to an embodiment of the invention.

FIG. 3 shows an example of an application tip 1 in accordance with an embodiment of the present invention. The main body 3 of this application tip has an oval oblong shape, which could be described as ruby ball like shape. Except the shape of the main body, the aspects of the application tip described with reference to FIGS. 1 and 2 apply to this embodiment.

Figure 4:
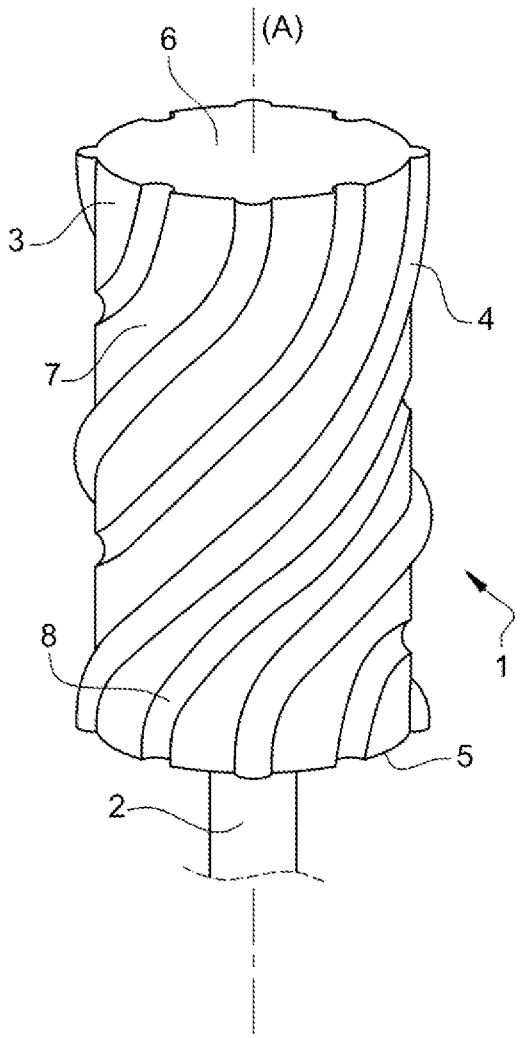
FIG. 4 is a schematic view of an application tip according to an embodiment of the invention.

FIG. 4 shows another example of an application tip 1 in accordance with an embodiment of the present invention. The main body 3 of this application tip has a cylindrical shape. In the illustrated example, a furrow 8 is formed between each pair of successive beads 4. In this example, the furrow 8 is barely wide. Alternatively, it could cover the entire width present between two successive beads 4. Except the shape of the main body, the aspects of the application tip described with reference to FIGS. 1 and 2 apply to this embodiment.

Other shapes of the main body 3 may be considered. In particular, the main body may narrow progressively in the direction of the second end 6, so as to have, for example, an ogive-like shape.

Figure 5:
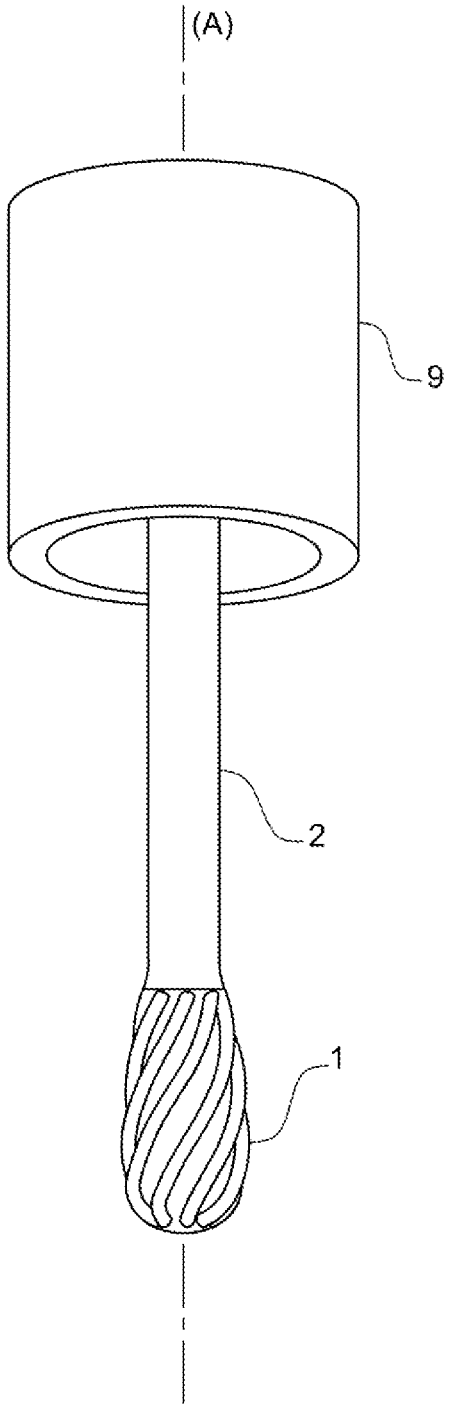
FIG. 5 is a three-dimensional view of an applicator in accordance with an embodiment of the invention.

FIG. 5 shows an applicator including an application tip 1 as described before. The applicator includes a gripping element 9 herein formed by a cap adapted to be screwed onto a cosmetic product bottle including an adapted neck. To this end, the cap may be provided with a tapping. According to other embodiments, the cap could be adapted to be attached to the bottle by snapping on.

The gripping element 9 is adapted to be gripped by hand by a user wishing to use the applicator.

The applicator extends according to a longitudinal general direction of extension, which therefore corresponds to the main axis A of the application tip 1.

The application tip 1 is joined end-to-end to the stick 2. The stick 2 is, itself, fastened to the gripping element 9.

The application tip 1 may be rigidly fastened, without any degree of freedom, to the stick 2 and the stick 2 may be rigidly fastened, without any degree of freedom, to the gripping element 9. Nevertheless, according to a preferred embodiment, the application tip is rotatably mounted, around the main axis A, relative to the gripping element 9.

This may be achieved by mounting the application tip 1 freely rotatable relative to the stick 2, or by mounting the stick 2 freely rotatable relative to the gripping element 9.

Figure 6:
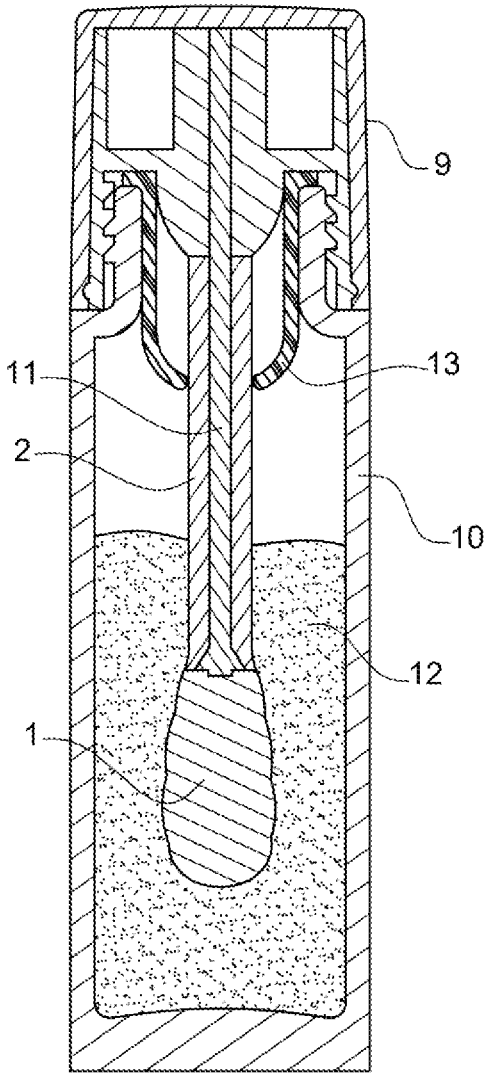
FIG. 6 is a sectional view of a set including the applicator of FIG. 5 and a cosmetic product bottle.

FIG. 6 shows a set including the applicator of FIG. 5 and a cosmetic product bottle 10.

In this example, the application tip 1 is rigidly fastened to the stick 2. The stick 2 is hollow, and rotatably mounted on a rigid and longitudinal core 11, which is rigidly fastened to the gripping element 9.

However, the stick 2 is fixed in translation along the core 11.

The bottle 7 forms an inner volume containing a liquid, viscous or pasty, for example semi-liquid, cosmetic product 12.

When the applicator is affixed on the bottle 10 (the gripping element 9 forming a suitable cap), the application tip 1 is in contact with the cosmetic product 12. For example, the application tip 1 is immersed in the cosmetic product 12. Thus, the application tip 1 is loaded with the cosmetic product, at its surface in particular in the spaces formed between the beads of the applicator 1.

The bottle 10 includes a squeegee 13. The squeegee 13 is a flexible device located proximate to the neck of the bottle 10 or in the latter. The squeegee 13 forms a passage calibrated for the insertion and removal of the application tip 1. The squeegee 13 allows pulling the excess cosmetic product off the application tip 1 upon removal thereof from the bottle 10. Yet, to avoid all of the cosmetic product or almost all of the cosmetic product being wiped and pulled off the application tip 1 upon passage of the application tip 1, the beads it bears protects, thanks to their spiralling configuration, the spaces 7 located between the beads from excessive wiping.

Thus, whenever it is extracted from the bottle 10, the application tip 1 is loaded with a precise quantity of cosmetic product. Depending on the configuration of the application tip 1 and depending on the physical-chemical properties of the cosmetic product 12, the application tip 1 is loaded after passage in the squeegee 13 with a predetermined, accurate, regular and optimum amount of cosmetic product, for application over a given area of the body of the user. For example, the applicator can be loaded with a predetermined dose of cosmetic product that is precise, even and optimum for applying under or around an eye.

The squeegee 13 may be of the so-called "turning-over squeegee" type. Such a squeegee 13 has a frustoconical shape and tends to turn over when the application tip 1 passes.

Advantageously, the squeegee may also include an orifice allowing balancing the pressure between the inner volume of the bottle and the outside of said bottle (i.e. the atmosphere, or ambient air). This avoids creating a mechanical resistance upon extraction of the applicator from the bottle, or insertion of the applicator into the bottle, and avoids the generation of a Venturi effect upon extraction of the applicator from the bottle.

The cosmetic product application tip, including the care product, thus developed according to the invention enables an even application, in a thin and even film, of an accurate amount of product throughout rotation over the skin of the user. The beads formed at the surface of the main body of the applicator accompany the application movement, and allows for an even adhesion, without jerking, over the skin of the user. They also promote the massage effect during application of the product.

The invention claimed is:

1. A cosmetic product application tip comprising:

a main body having an axisymmetric general shape around a main axis defining a longitudinal direction;

beads are formed at a surface of said main body from which each of said beads projects extending while spiraling around the main axis; and the beads being elongate elements having a length, the beads being formed at the surface of the main body and projecting from said surface over an entire length of the beads.

2. The application tip according to claim 1, wherein:

a furrow is formed over the main body in each space between two beads.

3. The application tip according to claim 1, wherein:

the main body is metallic, made of a ceramic, or of wood.

4. The application tip according to claim 1, wherein:

the main body is made of a plastic material.

5. The application tip according to claim 1, wherein:

the beads are formed integrally in one-piece with the main body.

6. The application tip according to claim 1, wherein:

the beads are formed of an elastomeric material.

7. The application tip according to claim 1, wherein:

each of said beads is configured to turn around the main axis over an angle comprised between 90° and 720°.

8. The application tip according to claim 1, wherein:

each of said beads is configured to turn around the main axis by an angle in a range of 180°.

9. The application tip according to claim 7, wherein:

the beads have a section whose dimensions are variable along each bead.

10. The application tip according to claim 1, wherein:

said beads include exactly three, four, five, six, seven, eight, nine or ten beads.

11. The application tip according to claim 1, wherein:

each bead has a rounded section with no sharp edges.

12. The application tip according to claim 1, wherein:

the beads have a roughness different from a roughness of the main body.

13. The application tip according to claim 1, wherein:

the main body has a so-called bud-like shape in a form of an elongate axisymmetric shape flaring progressively and terminating in a rounded tip.

14. The application tip according to claim 1, wherein:

the main body has a spherical, axisymmetric cylindrical, or ogive-like shape.

15. A cosmetic product applicator including an application tip according to claim 1, further comprising:

a gripper and a longitudinal rigid stick linking the gripper to the application tip.

16. The cosmetic product applicator according to claim 15, wherein:

the application tip is rotatably mounted, around the main axis, in relation to the gripper.

17. A set including a bottle and an applicator according to claim 15, wherein:

the bottle contains the cosmetic product, the bottle including a neck configured to be sealed off by the gripper, so that, when the bottle is sealed off by said gripper, the application tip is in contact with the cosmetic product.

18. The set according to claim 17, wherein:

the bottle includes a squeegee, the squeegee allowing wiping the application tip upon passage thereof, so that a definite amount of product is carried by the application tip after extraction of the applicator from the bottle.

* * * * *